United States Patent [19]

Brewster

[11] Patent Number: 4,596,202

[45] Date of Patent: Jun. 24, 1986

[54] COLLAPSIBLE BOAT ANCHOR

[76] Inventor: Robert L. Brewster, 20200 Highway 108, Sonora, Calif. 95370

[21] Appl. No.: 587,512

[22] Filed: Mar. 8, 1984

[51] Int. Cl.[4] ..... B63B 21/24

[52] U.S. Cl. ..... 114/303

[58] Field of Search ..... 114/294, 297–299, 114/301, 302, 303, 306–308; 294/80, 82 R

[56] References Cited

U.S. PATENT DOCUMENTS

| | | | |
|---|---|---|---|
| 1,899,866 | 2/1933 | Harvey | 114/299 |
| 2,490,583 | 12/1949 | Dunkelberger | 114/303 |
| 3,285,218 | 11/1966 | Gilbertson et al. | 114/303 |
| 4,403,564 | 9/1983 | Garvin | 114/303 |

FOREIGN PATENT DOCUMENTS

| | | | |
|---|---|---|---|
| 32791 | 1/1911 | Sweden | 114/304 |

*Primary Examiner*—Jesûs D. Sotelo

*Attorney, Agent, or Firm*—Mark C. Jacobs

[57] ABSTRACT

A collapsible boat anchor comprising a fixed grapple and a movable grapple, the fixed grapple including a shaft having the movable grapple thereon. The shaft also includes a releasable lock adapted to unlock the movable grapple so that it lies parallel to the fixed grapple allowing storage of the anchor. The lock, in its locked position, locks the movable grapple in a fixed position whereby it extends transverse to the fixed grapple allowing the grapples to act as an anchor. The anchor also includes a tethering member selectively adapted to pull the anchor into an anchoring position or pull the anchor in a reverse direction to release the same.

9 Claims, 5 Drawing Figures

COLLAPSIBLE BOAT ANCHOR

BACKGROUND OF THE INVENTION

1. Field of the Invention

The invention relates to boat anchors; and, more particularly, to a collapsible boat anchor.

2. Description of the Prior Art

There has always been a need for a boat anchor which can be used to anchor a boat or the like but takes up as little storage as possible. In U.S. Pat. No. 671,246 to Stuth, a collapsible boat anchor is disclosed but requires a cotter pin to hold the flukes in a fixed, operative position. Obviously, such pins could fall out when the anchor is being used or be easily lost. In addition, once anchored, there is no means for releasing such anchor by pulling against the direction of anchoring.

There is thus a need for a boat anchor which can be collapsed to a flat condition for storage, then quickly and easily locked into a position for anchoring. Such anchor should also have means for releasing the same from its anchoring position by pulling against its direction of anchor.

SUMMARY OF THE INVENTION

It is an object of this invention to provide an improved collapsible boat anchor.

It is a further object of this invention to provide a boat anchor that can be quickly and easily collapsed to a flat storage position, then assembled quickly and easily to an anchoring position.

It is still further an object of this invention to carry out the foregoing object while providing a release on the anchor to release the same by enabling pulling in a direction opposite its anchoring direction to release the same.

These and other objects are preferably accomplished by providing a collapsible boat anchor comprising a fixed grapple, and a movable grapple, the fixed grapple including a shaft and movable grapple thereon. The shaft also includes a releasable lock adapted to unlock the movable grapple so that it lies parallel to the fixed grapple allowing storage of the anchor. The lock, in its locked position, locks the movable grapple in a fixed position whereby it extends transverse to the fixed grapple allowing the grapples to act as an anchor. The anchor also includes a tethering member selectively adapted to pull the anchor into an anchoring position or pull the anchor in a reverse direction to release the same.

DESCRIPTION OF THE PREFERRED EMBODIMENT

Figure 1:
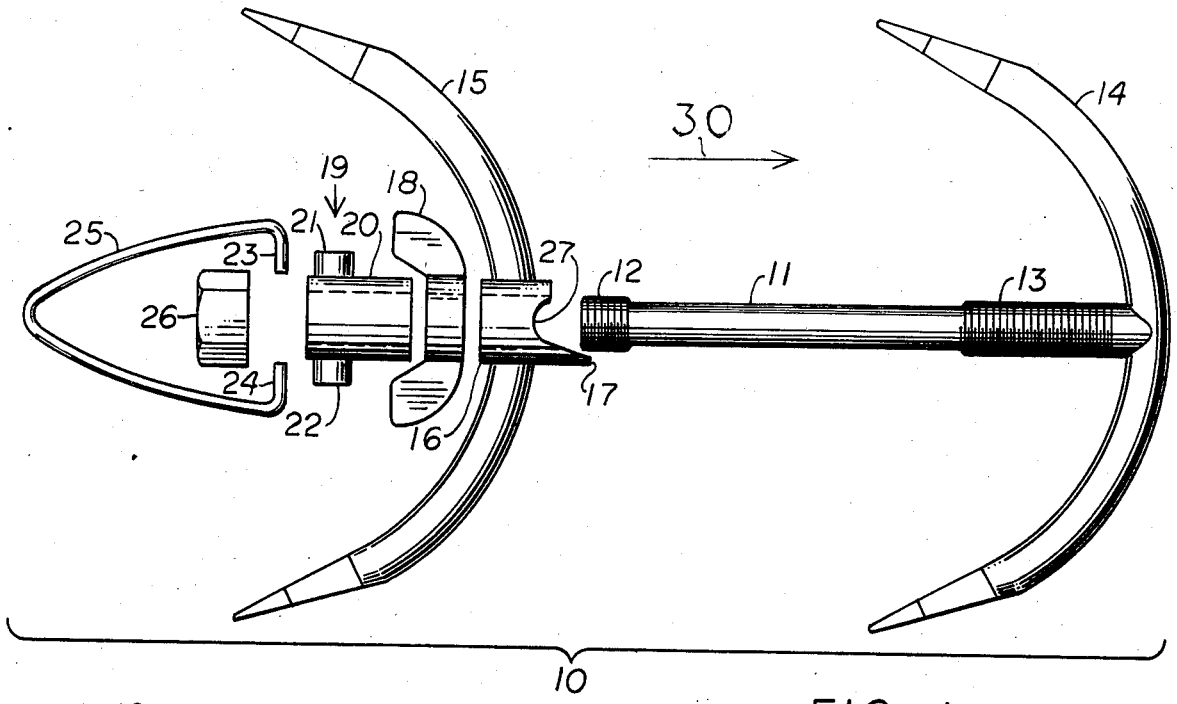
FIG. 1 is an exploded view of a collapsible boat anchor in accordance with the teachings of the invention.

Referring now to FIG. 1 of the drawing, a collapsible boat anchor 10 is shown in exploded view. Anchor 10 includes a main body 11 in the preferred form of a cylindrical shaft terminating at one end in a first threaded portion 12 and at the other end in a second threaded portion 13. A grapple 14, which may be crescent-shaped as shown terminating at each end in a pair of flukes, is fixedly secured to threaded portion 13, as by welding. Of course, grapple 14 may be secured to portion 13 in any suitable manner and may comprise one or more curved prongs.

A second grapple 15, similar to grapple 14, is provided, preferably similarly configured, having a centrally located cylindrical portion such as sleeve 16. Sleeve 16 includes an elongated flange 17 extending toward grapple 14 and a curved portion 27 for reasons to be discussed. A threaded wing nut 18 is provided adapted to threadably engage threaded portion 13. A T-shaped member 19 is also provided having a main cylindrical body portion 20, smooth-walled on the interior, and a pair of hollow axially aligned smaller bosses or cylindrical portions 21,22 on each side of body portion 20 to the rear thereof as shown in FIG. 1. These portions 21,22 are adapted to receive the inwardly extending legs 23,24 of a V-shaped spring member 25. It is to be understood that member 25 is preferably a resilient wire member so that legs 23,24 can be spread apart and inserted into portions 21,22 as shown in FIG. 2.

Finally, a terminal threaded end nut 26 is provided adapted to threadably engage the threaded portion 12.

Figure 2:
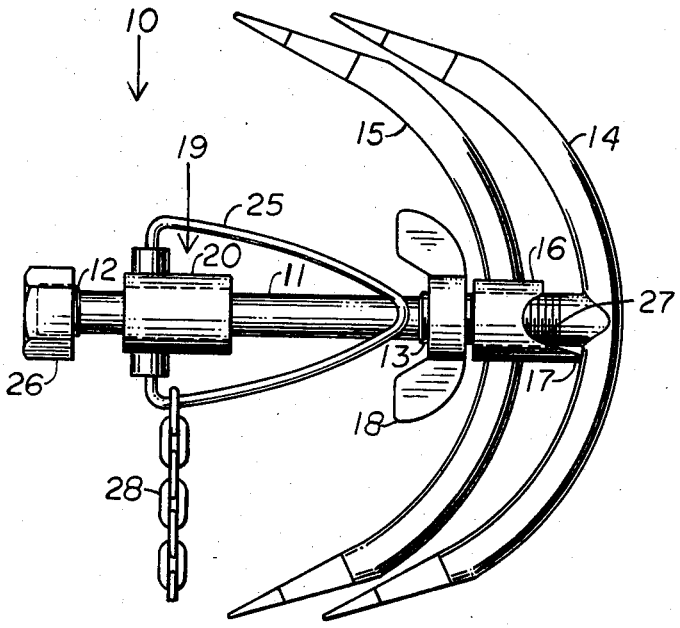
FIG. 2 is an assembled view of the anchor of FIG. 1 showing the anchor in its collapsed position.

The assembled anchor 10 is shown in FIG. 2. Sleeve 16 of FIG. 1 is inserted onto shaft 11 until flange 17 abuts against grapple 14 (FIG. 2). It can be appreciated that flange 17 can pivot about its point of contact with grapple 14 so that grapple 14 enters the curved portion 27 (see FIG. 3).

Figure 3:
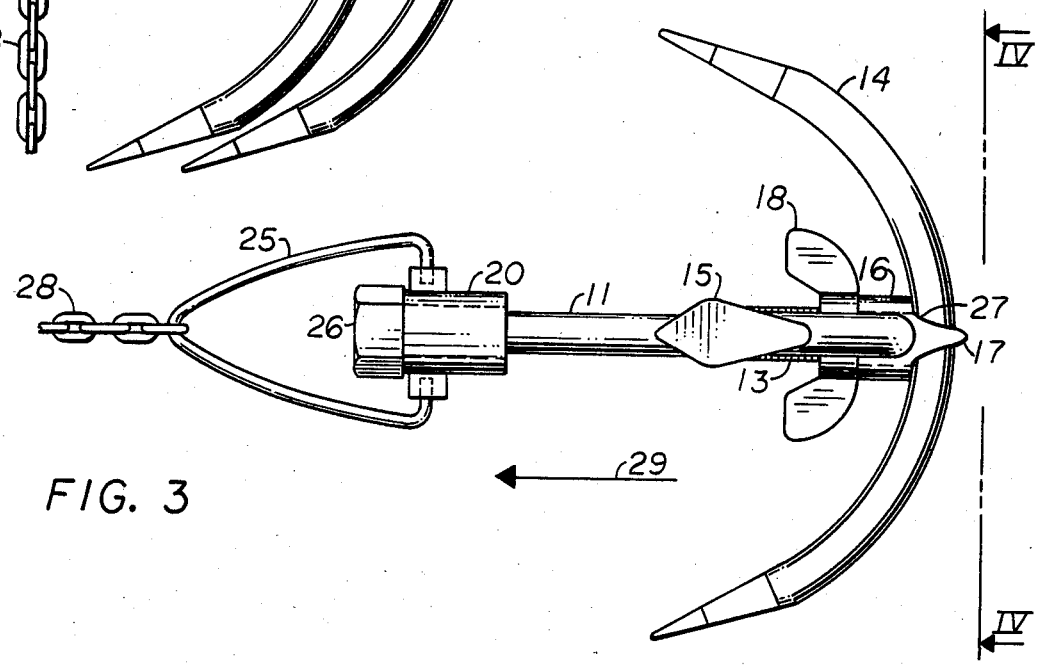
FIG. 3 is an assembled view of the anchor of FIG. 1 showing the anchor in its locked or anchoring position.
Figure 4:
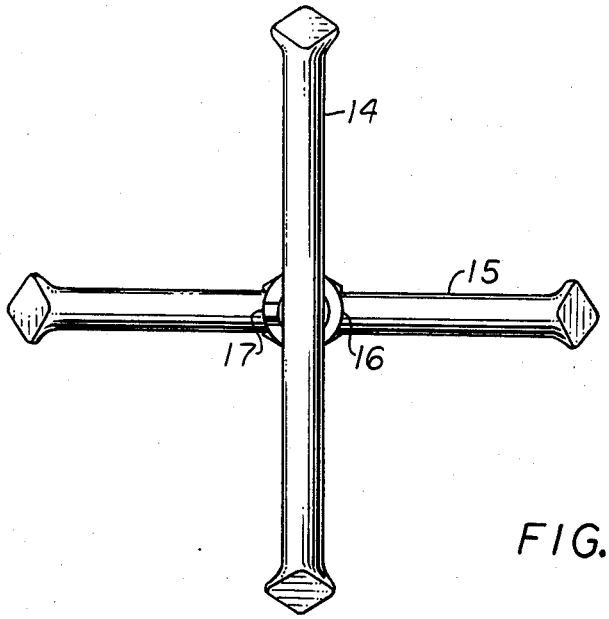
FIG. 4 is a view taken along the lines IV—IV of FIG. 3.

Referring again to FIGS. 1 and 2, wing nut 18 is then threaded onto the threaded portion 13 of shaft 11 and tightened against sleeve 16 as shown in FIG. 3 locking grapples 14,15 in a four-prong position shown in FIG. 4. As seen in FIG. 2, however, if wing nut 18 is loosened as shown, the grapple 15 moves back and rotates from the FIG. 4 position to the FIG. 2 position whereby grapples 14 and 15 are parallel to each other.

Legs 23,24 are now inserted into portions 21,22 and sleeve portion 20 is inserted onto shaft 11 (FIG. 2) and is adapted, since portion 20 is not threaded, to move back and forth along shaft 11 between wing nut 18 and end 12. Finally, nut 26 is threaded onto threaded end 12 and, of course, prevents removal of sleeve portion 20 therefrom.

It can be appreciated that the free movement of sleeve portion 20 between nut 26 and wing nut 18 also allows pivotting of portion 20 about shaft 11. If desired, a rope or chain 28 may be attached to spring member 25 (FIG. 2). Of course, in use, the tether is obviously attached.

In operation, anchor 10 may be used to secure a boat or the like. It can be folded flat for stowage as shown in FIG. 2 where grapples 14 and 15 are parallel to each other and wing nut 18 is loosened. Thus, in the FIG. 2 position, it takes up less space than prior art devices. When wing nut 18 is tightened, as shown in FIG. 3, grapple 14, which is preferably generally cylindrical in cross-section, enters into and conforms to curved portion 27. Thus, grapple 15 is locked in a position whereby it extends transverse to grapple 14 (as shown in FIG. 4). This of course is the optimum position for the anchor 10 to hook up to or catch onto some underwater structure or formation, or dig into the bottom to secure the boat or the like to which chain 28 may be attached when member 25 is pulled in the direction of arrow 29 (FIG. 3) and sleeve portion 20 abuts the underside of nut 26. When it is desired to loosen the anchor 10, since sleeve portion 20 is loose on shaft 11, member 25 can be pulled via chain 28 in the direction of arrow 30 in FIG. 2 which pulls grapples 14 and 15 (locked in the FIG. 4 position) in a reverse direction away from its grappling or clamping position thereby releasing anchor 10. This may be accomplished by the boat or the like reversing direction thus pulling anchor 10 loose and allowing it to be raised to the surface, for retrieval.

Figure 5:
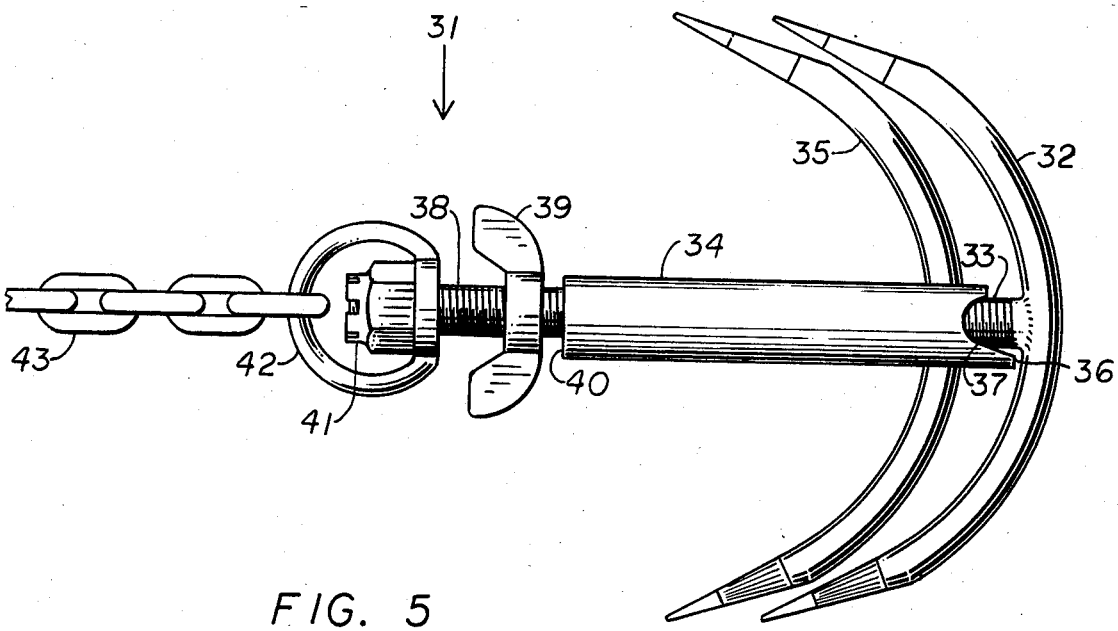
FIG. 5 is a view of a modified anchor in accordance with the invention in a position similar to that of the anchor of FIG. 2.

A modification of a collapsible anchor in accordance with the teachings of the invention is shown in FIG. 5. It is to be understood that anchor 31 of FIG. 5 is used exactly the same as anchor 10 and, thus, the foregoing comments concerning anchor 10 are deemed pertinent with respect to anchor 31. In anchor 31, grapple 32 is welded or otherwise secured to a tube or shaft 33 telescopingly received in a hollow tubular shaft 34. Grapple 35 is welded or otherwise secured to shaft 34 at the end thereof adjacent grapple 32. A flange 36, otherwise similar in shape and function to flange 17, is provided at the end of shaft 34 adjacent grapple 32. The terminal end 37 of shaft 34 is inwardly concave similar to aforementioned curved portion 27 for receiving grapple 32 therein.

Shaft 33 is threaded at end 38 and a wing nut 39 is threaded thereon. It can be appreciated that loosening nut 39 allows flange 36 to move to the FIG. 5 position, as shown, and tightening nut 39 against the terminal end 40 of sleeve 34, when grapples 32 and 35 are in the position shown in FIG. 4 for grapples 14,15, locks the grapples 32 and 35 in such X-shaped position. This of course is the operative position for anchor 31 whereas FIG. 5 is the inoperative or stowed position.

A castle nut 41 is threaded onto end 38. A swivel 42 having a rope or chain 43 connected thereto is loosely disposed on shaft end 38 and freely movable between nut 41 and nut 39. The swivel 42 can of course also swivel or turn about nut 41 since it can obviously be of greater internal diameter than shaft 33 and, thus, anchor 31 can be pulled in different directions or against the direction of anchor (as discussed hereinabove with respect to anchor 10) to unhook the same. Of course, swivel 42 can be made of any suitable type or configuration, such as a universal swivel, to provide for both rotatable and lateral movement of the chain 43 tethered thereto.

It can be seen that there is disclosed a boat anchor that may be collapsed to a flat position, then quickly and easily assembled into a pronged operative hooking position. The anchor can then hook or engage an underwater structure or underlying water bottom, then released by pulling in a direction against the hooking direction.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In a boat anchor having a first fixed grapple comprised of a pair of flukes extending in opposite directions and a shaft interconnecting the flukes at generally their point of intersection, a second movable grapple slidably and rotatably mounted on said shaft also comprised of a pair of flukes extending in opposite directions, and locking means for locking said movable grapple in a fixed position whereby its flukes extend in a direction transverse to the direction of the flukes of said first fixed grapple, the improvement which comprises:

said locking means includes a threaded portion on said shaft, said second movable grapple having a smooth inner walled collar portion encircling said shaft, said locking means also including a threaded nut on said shaft adapted, in a first position, to permit said second movable grapple to move away from said first fixed grapple to a position whereby the flukes of said second movable grapple are generally parallel to the flukes of said first fixed grapple, and, in a second position, to engage said threaded portion to lock said second movable grapple against said first fixed grapple whereby the flukes of said first fixed grapple extend transverse to the flukes of said second movable grapple, wherein said collar portion includes an elongated flange extending toward said first fixed grapple whereby said flange, when said nut is in said first position, abuts against said first fixed grapple and, when said nut is in said second position, extends across said first fixed grapple.

2. In the anchor of claim 1 including a tether collar mounted on said shaft having a smooth-walled inner wall and rotatable on said shaft, and a pivoted member coupled to said collar and pivotable from a first position extending in a direction away from said first fixed grapple to a second position extending toward said first fixed grapple.

3. In the anchor of claim 2 including a tether coupled to said pivoted member.

4. In the anchor of claim 1 wherein said second movable grapple includes a tubular shaft receiving said first mentioned shaft therein, said threaded portion extending out of said second mentioned shaft.

5. In the anchor of claim 4 including an abutment member mounted on said first mentioned shaft at the end thereof remote from said first fixed grapple, and a ring encircling said first mentioned shaft between said abutment member and said nut, said ring being pivotally mounted on said first mentioned shaft and having a tether secured thereto.

6. In a boat anchor having a first fixed grapple comprised of a pair of flukes extending in opposite directions and a shaft interconnecting the flukes at generally their point of intersection, a second movable grapple slidably and rotatably mounted on said shaft also comprised of a pair of flukes extending in opposite directions, and locking means for locking said movable grapple in a fixed position whereby its flukes extend in a direction transverse to the direction of the flukes of said first fixed grapple, the improvement which comprises:

said locking means includes a threaded portion on said shaft, said second movable grapple having a smooth inner walled collar portion encircling said shaft, said locking means also including a threaded nut on said shaft adapted, in a first position, to permit said second movable grapple to move away from said first fixed grapple to a position whereby the flukes of said second movable grapple are generally parallel to the flukes of said first fixed grapple, and, in a second position, to engage said threaded portion to lock said second movable grapple against said first fixed grapple whereby the flukes of said first fixed grapple extend transverse to the flukes of said second movable grapple, including a tether collar mounted on said shaft having a smooth-walled inner wall and rotatable on said shaft, and a pivoted member coupled to said collar and pivotable from a first position extending in a direction away from said first fixed grapple to a second position extending toward said first fixed grapple wherein said collar is a T-shaped member having a first portion encircling said shaft and second and third hollow portions on opposite sides of said first portion, the axes of said second and third portions being coaxial and said pivoted member being a V-shaped member having a pair of legs insertable into said second and third portions, respectively.

7. In the anchor of claim 6 wherein said V-shaped member is a rigid resilient wire.

8. In the anchor of claim 6 including an abutment member mounted on the end of said shaft opposite that of said first fixed grapple, said first portion being mounted on said shaft between said abutment member and said nut.

9. A collapsible boat anchor comprising:

a first generally crescent-shaped member having flukes at each end and a shaft connected to said member at a point generally midway between said flukes, said shaft being threaded adjacent the point of connection to said member and at the terminal end thereof and being smooth-walled between said terminal end and said threaded portion adjacent said member;

a second generally crescent-shaped member having flukes at each end and a first smooth inner wall collar at generally the midpoint between the flukes of said second member, said collar having a pointed flange leading therefrom extending in the direction of said first member and encircling said shaft;

a first nut threaded at the portion of said shaft adjacent said first member with said second member disposed between the nut and said first member;

a second smooth inner wall collar mounted on said shaft remote from said nut having a pair of axially aligned bosses on opposite sides of said second collar;

a V-shaped resilient member having a pair of legs engaging said respective bosses; and a second nut threaded onto the terminal end of said shaft.

* * * * *